US009340050B2

(12) United States Patent
Otani et al.

(10) Patent No.: US 9,340,050 B2
(45) Date of Patent: May 17, 2016

(54) INK JET RECORDING APPARATUS AND INK JET RECORDING METHOD

(71) Applicant: CANON KABUSHIKI KAISHA, Tokyo (JP)

(72) Inventors: Takumi Otani, Kawasaki (JP); Eisuke Nishitani, Tokyo (JP); Fumihiro Goto, Kawasaki (JP); Koichiro Nakazawa, Machida (JP); Keiichirou Takeuchi, Komae (JP); Kanako Soma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/660,108

(22) Filed: Mar. 17, 2015

(65) Prior Publication Data

US 2015/0273919 A1 Oct. 1, 2015

(30) Foreign Application Priority Data

Mar. 28, 2014 (JP) ..... 2014-068273

(51) Int. Cl.

| | |
|---|---|
| ***B41J 29/393*** | (2006.01) |
| ***B41J 29/38*** | (2006.01) |
| ***B41J 2/205*** | (2006.01) |
| ***B41J 2/195*** | (2006.01) |

(52) U.S. Cl.
CPC ..... *B41J 29/393* (2013.01); *B41J 2/195* (2013.01)

(58) Field of Classification Search
CPC ..... B41J 29/393; B41J 3/445; B41J 2/2135; B41J 29/38; B41J 2/2139
USPC ..... 347/14, 15, 19
See application file for complete search history.

(56) References Cited

U.S. PATENT DOCUMENTS

2013/0222461 A1 * 8/2013 Kaszynski ..... 347/19

FOREIGN PATENT DOCUMENTS

JP 2004-142206 A 5/2004
JP 2004142206 A * 5/2004

* cited by examiner

*Primary Examiner* — Jannelle M Lebron
(74) *Attorney, Agent, or Firm* — Fitzpatrick, Cella, Harper & Scinto

(57) ABSTRACT

An ink jet recording apparatus includes a recording condition changing unit that changes a recording condition upon formation of an image; an evaluation image input unit that inputs evaluation image data representing an evaluation image including at least two successive adjacent dots to form the evaluation image on a recording medium; a reading unit that reads the evaluation image; an evaluation value calculating unit that calculates an evaluation value based on color information on the evaluation image; an acceptance/rejection determining unit that determines acceptance/rejection of the evaluation image by comparing the evaluation value with an acceptance/rejection determining threshold value; and a recording condition deciding unit that decides that a recording condition used during formation of an evaluation image of which acceptance has been determined is to be used as a recording condition upon formation of the image on the recording medium.

10 Claims, 8 Drawing Sheets

INK JET RECORDING APPARATUS AND INK JET RECORDING METHOD

BACKGROUND OF THE INVENTION

1. Field of the Invention

The present invention relates to an ink jet recording apparatus and an ink jet recording method.

2. Description of the Related Art

When an image is formed by an ink jet system in which ink droplets are caused to fly toward a recording medium, a beading phenomenon occurs in which ink that has been already applied on the recording medium is pulled toward ink that is applied later. The ejected individual ink droplets are each referred to as a dot or a recording dot. A phenomenon in which an individual dot that has been already applied on the recording medium is drawn toward an individual dot that is subsequently applied thereon is referred to as micro-beading.

When micro-beading occurs, the image quality of a fine line or letter portion in the formed image substantially deteriorates, and the uniformity of a solid image portion substantially deteriorates. In order to suppress such deterioration in image quality, there is known a method of quickly increasing the viscosity of ink that has been applied on the recording medium by applying in advance, onto the recording medium, a reaction liquid for forming an ink image having an increased viscosity by coming into contact with a coloring material component in the ink.

Further, particularly in the commercial printing field, various types of recording media are used. When a wide variety of recording media are used, there is a problem in that unless a recording condition, such as a recording speed, temperature and humidity of the recording medium, type of ink, temperature of the ink, and application amount of the reaction liquid, is appropriately changed based on the type of the recording medium, micro-beading occurs to deteriorate image quality.

As an example of a method for solving such a problem, in Japanese Patent Application Laid-Open No. 2004-142206, a method is proposed in which a recording condition is selected by recording a test pattern prepared in advance on a recording medium and visually determining the image quality of the recorded test pattern.

However, when the method described in Japanese Patent Application Laid-Open No. 2004-142206 is used, the recording condition is set by visually determining the test pattern formed as an image on the recording medium. Hence, there is a problem in that a different determination may be made depending on the person performing the determination, so that an appropriate recording condition cannot be quantitatively set. Further, even if the person performing the determination is the same, differences in the determination can arise while repeating the cycle of forming the image, observing the image, performing the determination, and setting the recording condition.

SUMMARY OF THE INVENTION

It is an object of the present invention to provide an ink jet recording apparatus and an ink jet recording method capable of setting a recording condition appropriate for a recording medium by objectively and quantitatively evaluating the recording condition instead of subjectively determining the recording condition based on visual observation of an image formed on the recording medium.

In order to achieve the above-mentioned object, according to an embodiment of the present invention, there is provided an ink jet recording apparatus, which is configured to form an image corresponding to image data by applying ink droplets on a recording medium, the ink jet recording apparatus including a recording condition changing unit configured to change a recording condition to be used upon formation of the image using the ink jet recording apparatus; an evaluation image input unit configured to input evaluation image data representing an evaluation image as the image data in order to form the evaluation image on the recording medium, the evaluation image being an image including at least two successive adjacent dots; a reading unit configured to read the evaluation image formed on the recording medium; an evaluation value calculating unit configured to calculate an evaluation value based on color information on the evaluation image read by the reading unit; an acceptance/rejection determining unit configured to determine acceptance/rejection of the evaluation image formed on the recording medium by comparing the evaluation value calculated by the evaluation value calculating unit with an acceptance/rejection determining threshold value; and a recording condition deciding unit configured to decide that a recording condition used during formation of an evaluation image of which acceptance has been determined by the acceptance/rejection determining unit is to be used as a recording condition upon formation of the image on the recording medium.

According to an embodiment of the present invention, there is provided an ink jet recording method of forming an image corresponding to image data by applying ink droplets on a recording medium, the ink jet recording method including a recording condition changing step of changing a recording condition to be used upon formation of the image; an evaluation image forming step of forming an evaluation image on the recording medium under the recording condition set in the recording condition changing step, the evaluation image being an image including at least two adjacent dots; a reading step of reading the evaluation image formed on the recording medium; an evaluation value calculating step of calculating an evaluation value based on color information on the evaluation image read in the reading step; an acceptance/rejection determining step of determining acceptance/rejection of the evaluation image formed on the recording medium by comparing the evaluation value calculated in the evaluation value calculating step with an acceptance/rejection determining threshold value; and a recording condition deciding step of deciding that a recording condition used during formation of an evaluation image of which acceptance has been determined in the acceptance/rejection determining step is to be used as a recording condition upon formation of the image on the recording medium.

According to the present invention, a recording condition to obtain a high quality image is identified by forming an evaluation image on a recording medium while changing the recording condition, calculating an evaluation value based on the color information obtained by reading the formed evaluation image, and determining acceptance/rejection by comparing the evaluation value with an acceptance/rejection determining threshold value. The evaluation value calculated based on the color information is a value quantitatively representing a level of deterioration in image quality, such as micro-beading, for each recording condition. Therefore, according to the present invention, the recording condition suitable for a recording medium can be set without depending on subjective determination to form an image on the recording medium under that recording condition.

Further features of the present invention will become apparent from the following description of exemplary embodiments with reference to the attached drawings.

DESCRIPTION OF THE EMBODIMENTS

Figure 1:
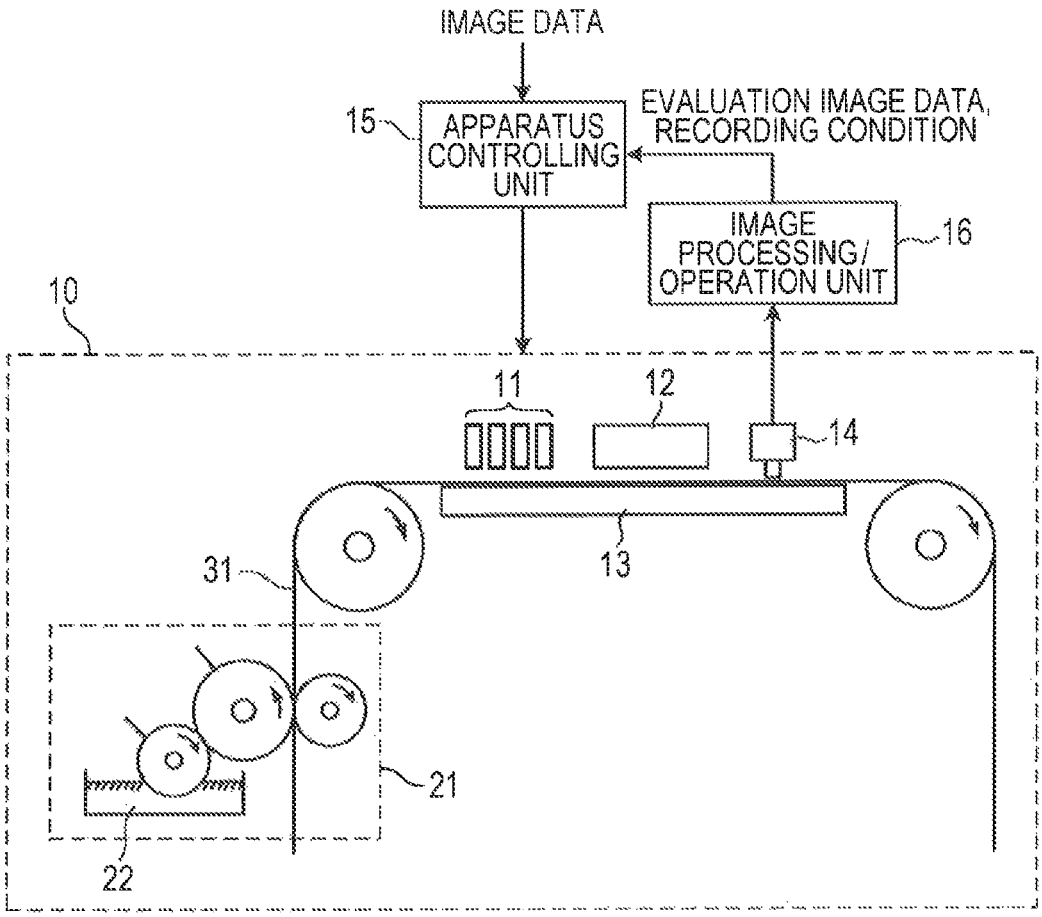
FIG. 1 is a schematic diagram illustrating an ink jet recording apparatus according to an embodiment of the present invention.

Next, an exemplary embodiment of the present invention is described with reference to the drawings. FIG. 1 illustrates an ink jet recording apparatus according to an embodiment of the present invention.

The ink jet recording apparatus illustrated in FIG. 1 is configured to form an image on a recording medium by applying ink onto the recording medium 31. In particular, regarding a recording condition when the ink is applied, the ink jet recording apparatus according to this embodiment enables a recording condition that does not cause micro-beading on the recording medium 31 to be automatically decided based on the type of the recording medium 31. Specifically, in this embodiment, a recording condition that does not cause micro-beading is set by recording an evaluation image on the recording medium 31 while changing the recording condition, and quantitatively evaluating the level of micro-beading at each recording condition based on the color density of the recorded image.

In the following description, first, the ink jet recording apparatus according to this embodiment is described, and then an ink jet recording method according to the present invention is described, in which a recording condition that does not cause micro-beading is set by quantitatively evaluating the level of micro-beading. Note that, in this specification, "recording medium" includes not only paper used in common printing, "recording medium" also widely includes other printing media and recording media capable of being used in an ink jet system, such as fabrics, plastics, films, and the like.

Broadly categorized, the ink jet recording apparatus illustrated in FIG. 1 includes a recording unit 10 configured to apply ink onto the recording medium 31, an apparatus controlling unit 15 configured to control the recording unit 10, and an image processing/operation unit 16 configured to set the recording condition. The apparatus controlling unit 15, which is provided with image data representing the image to be formed on the recording medium 31, is configured to control recording operation of the recording unit 10.

The recording unit 10 includes a conveyance system configured to convey the recording medium 31. In the conveyance system, a roller application device 21 configured to apply a reaction liquid 22 on a surface of the recording medium 31 is arranged on the feeding side of the recording medium 31. The reaction liquid 22 is applied for forming an ink image having a higher viscosity due to contact with coloring material components in the ink. The recording unit 10 also includes a support member 13 for supporting the conveyed recording medium 31 on which the reaction liquid 22 has been applied. An ink jet recording head 11, an air blowing device 12, and an imaging device 14 are arranged in this order facing the support member 13.

The ink jet recording head 11 is configured to form an image based on image data on the recording medium 31 by causing ink droplets to fly toward the recording medium 31 under the control of the apparatus controlling unit 15. The air blowing device 12 is configured to remove moisture in the ink by air blowing toward the recording medium 31 on which ink has been applied. The imaging device 14, which functions as a reading unit, is configured to take the image formed on the recording medium 31. The imaging device 14 is described in more detail below.

In such an ink jet recording apparatus, first, the reaction liquid 22 is applied on the recording medium 31 by the roller application device 21. Next, the recording medium 31 on which the reaction liquid has been applied is conveyed above the support member 13. Then, first, the recording medium 31 arrives at the position of the ink jet recording head 11, and the recording medium 31 receives ink applied from the ink jet recording head 11, whereby an image is formed. Then, the recording medium 31 arrives at the position of the air blowing device 12, and moisture in the ink is removed by blown air. Then, the recording medium 31 arrives at the position of the imaging device 14, and the imaging device 14 takes the image formed on the recording medium 31.

The ink jet recording apparatus illustrated in FIG. 1 is configured in consideration of being used in commercial printing and the like. The configuration of this ink jet recording apparatus enables a recording condition in the recording unit 10 to be controlled by the apparatus controlling unit 15. Examples of the recording condition referred to herein may include, but are not limited to, driving frequency of the recording head, temperature of the ink, temperature of the recording medium, humidity of the recording medium, application amount of the reaction liquid on the recording medium, and the like. The driving frequency of the recording head indicates the ejection frequency when ink droplets are successively ejected from ejection orifices of the ink jet recording head.

Next, the image processing/operation unit 16 is described.

The image processing/operation unit 16 is provided to execute processing for automatically setting a recording condition that does not cause micro-beading in the ink jet recording apparatus according to this embodiment. The processing performed by the image processing/operation unit 16 is described below.

First, the image processing/operation unit 16 sets a recording condition in the recording unit 10 via the apparatus controlling unit 15. Then, the image processing/operation unit 16 outputs evaluation image data and causes the recording unit 10 to form an evaluation image on the recording medium 31. Next, the image processing/operation unit 16 calculates color information about the evaluation image recorded on the recording medium 31 based on imaging data obtained by taking the evaluation image with the imaging device 14 under the same imaging condition. Then, based on the calculated color information, the image processing/operation unit 16 determines whether or not micro-beading has occurred. When it is determined that micro-beading has occurred, the image processing/operation unit 16 changes the recording condition, records an evaluation image, and again determines whether or not micro-beading has occurred. On the other hand, when it is determined that micro-beading has not occurred, the image processing/operation unit 16 decides that the recording condition used when micro-beading did not occur is to be used as the recording condition when recording an image on the recording medium 31. Then, the image processing/operation unit 16 sets the decided recording condition in the recording unit 10 via the apparatus control unit 15.

Figure 2:
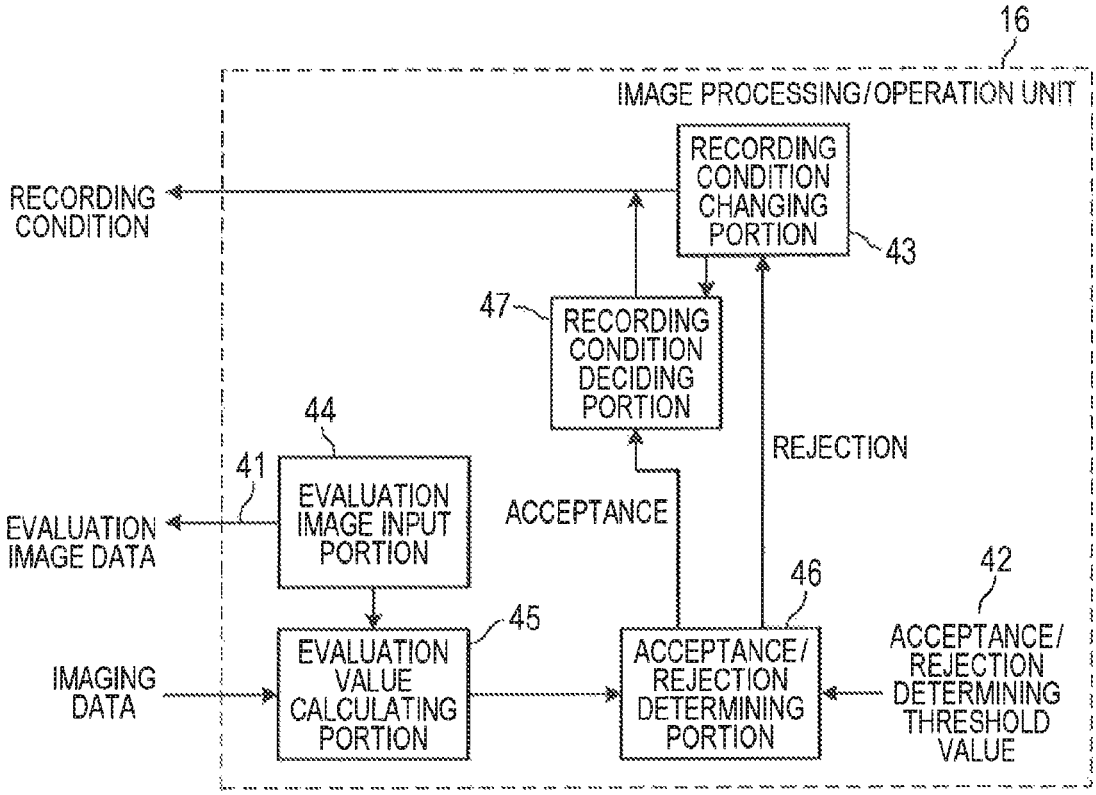
FIG. 2 is a block diagram illustrating a configuration of an image processing/operation unit.

The image processing/operation unit 16 to execute such processing includes, as illustrated in FIG. 2, a recording condition changing portion 43, an evaluation image input portion 44, an evaluation value calculating portion 45, an acceptance/rejection determining portion 46, and a recording condition deciding (or determining) portion 47.

The recording condition changing portion 43, which functions as a recording condition changing unit, is configured to set and change the recording condition to be used when forming the evaluation image on the recording medium 31, and then output the recording condition to the apparatus controlling unit 15. In particular, the recording condition changing portion 43 is configured to again change and re-set the recording condition in order to again form the evaluation image when a rejection signal is output from the acceptance/rejection determining portion 46. The recording condition to be changed by the recording condition changing portion 43 is at least one of, for example, the driving frequency of the recording head, the temperature of the ink, the temperature of the recording medium, the humidity of the recording medium, and the application amount of the reaction liquid on the recording medium.

The evaluation image input portion 44, which functions as an evaluation image input unit, is configured to output to the apparatus controlling unit 15 evaluation image data, which is image data corresponding to the evaluation image to be formed on the recording medium 31. An image having at least two successive adjacent dots is used as the evaluation image.

The evaluation value calculating portion 45, which functions as an evaluation value calculating unit, is configured to calculate an evaluation value for determining whether or not micro-beading has occurred in the evaluation image based on imaging data obtained by taking the evaluation image formed on the recording medium 31 with the imaging device 14. The calculation of the evaluation value is described in more detail below. When a plurality of evaluation images are prepared in advance, information indicating which evaluation image was used to determine whether or not micro-beading occurred is also required. Therefore, in such a case, the evaluation value calculating portion 45 acquires information relating to the used evaluation image from the evaluation image input portion 44.

The acceptance/rejection determining portion 46, which functions as an acceptance/rejection determining unit, includes an acceptance/rejection determining threshold value 42. The acceptance/rejection determining portion 46 is configured to determine whether or not micro-beading has occurred by comparing the evaluation value calculated by the evaluation value calculating portion 45 with the acceptance/rejection determining threshold value 42. When it is determined that micro-beading has occurred, the acceptance/rejection determining portion 46 outputs a signal indicating rejection (NG). When it is determined that micro-beading has not occurred, the acceptance/rejection determining portion 46 outputs a signal indicating acceptance (OK).

The recording condition deciding portion 47 functions as a recording condition deciding unit. When an acceptance signal is output from the acceptance/rejection determining portion 46 based on the determination that micro-beading has not occurred, the recording condition deciding portion 47 sets the recording condition used when micro-beading did not occur in the recording unit 10 via the apparatus controlling unit 15. If there are a plurality of recording conditions that do not cause micro-beading, as described below, it is preferred that the recording condition deciding portion 47 set the recording condition by arranging the recording conditions in order of priority. To set the recording condition, the recording condition deciding portion 47 acquires information relating to the current recording condition from the recording condition changing portion 43.

Next, the imaging device 14 functioning as a reading unit is described in more detail.

In this embodiment, an evaluation value for determining whether or not micro-beading has occurred is calculated. However, the type of an imaging device suited to that evaluation method depends on what kind of evaluation value is used.

Figure 7:
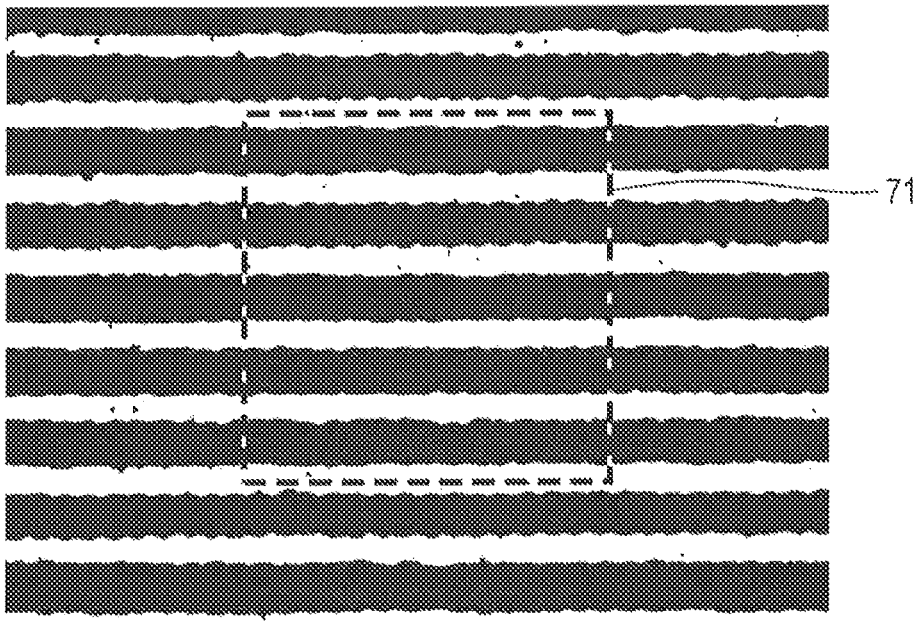
FIG. 7 illustrates an example of the evaluation image formed on the recording medium according to Example 1.
Figure 9A:
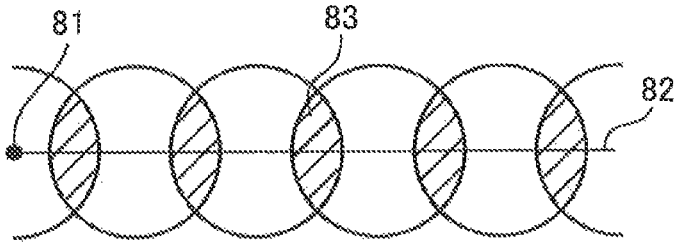
FIGS. 9A and 9B are schematic diagrams each illustrating the evaluation image according to Example 2.
Figure 9B:
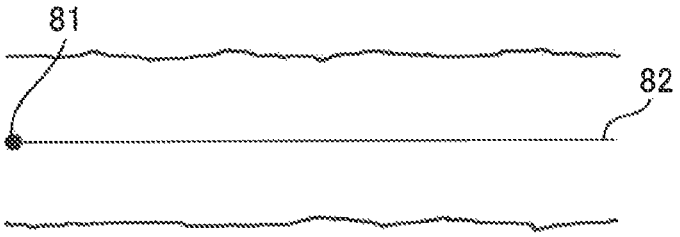

For example, as illustrated in FIG. 7, which is described in more detail below, when an evaluation image formed by repeatedly recording a fine line image plural times is evaluated with respect to a macro range, it is preferred to use an imaging device having a resolution that is the same as or several times greater than the resolution of the recording dots in the evaluation image. As illustrated in FIGS. 9A and 9B, when evaluation is made within the range of individual recording dots, it is necessary to use an imaging device having a reading resolution that has a higher definition than the recording dot resolution of the evaluation image. For example, it is desired that the reading resolution be about 20 to 30 times as high as the recording dot resolution.

When the evaluation value is taken based on lightness information on the evaluation image, it is necessary to use a device capable of taking the evaluation image as a monochrome or color image. Further, it is preferred that the imaging area have such a size that a change in the evaluation value is distinct when changing the recording condition. As illustrated in FIG. 7, when an evaluation image formed by repeatedly recording a fine line image plural times is evaluated, in order to reduce the effects of deviation of the application position of the recording dots and the like on the evaluation value, it is preferred to determine the imaging area based on the lightness period in the direction perpendicular to the fine line image.

As the reading unit in the present invention, in addition to the above-mentioned imaging device, a colorimeter such as an optical density (OD) meter may also be used. In this case, the measured spot diameter needs to be smaller than at least the size of the evaluation image.

Figure 3:
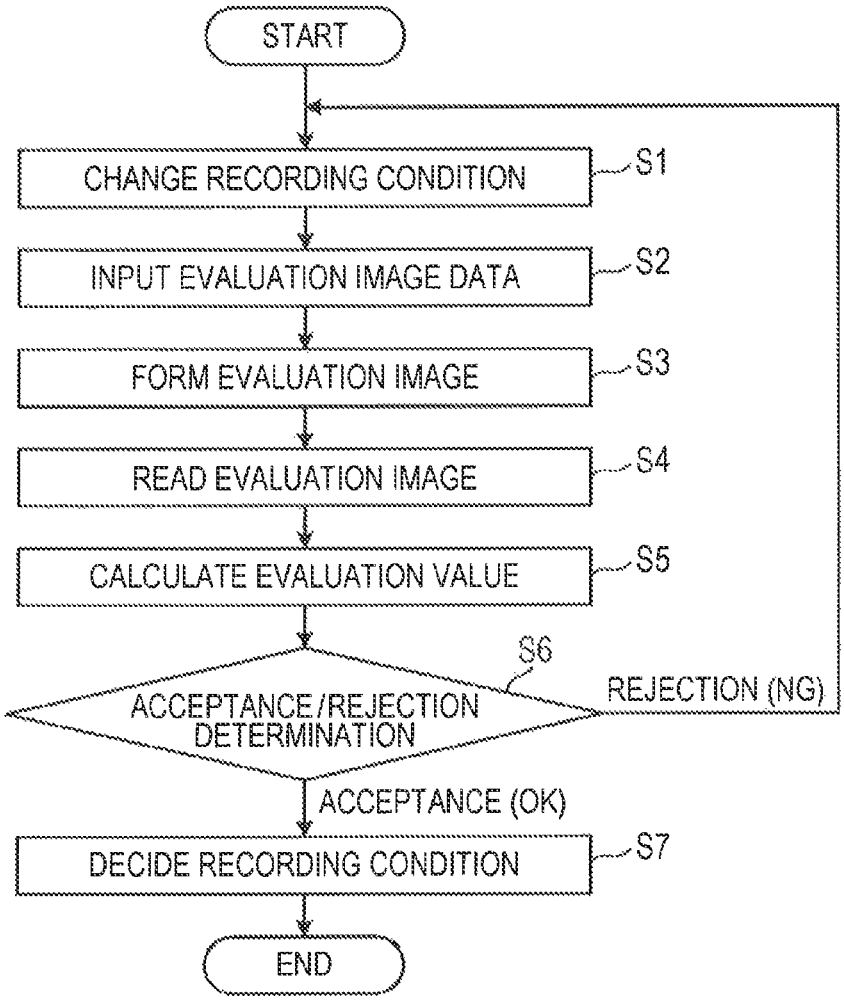
FIG. 3 is a flowchart illustrating processing for setting a recording condition in the ink jet recording apparatus illustrated in FIG. 1.

Next, setting of the recording condition by the ink jet recording apparatus according to this embodiment is described with reference to the flowchart illustrated in FIG. 3.

First, in Step S1, the recording condition changing portion 43 functioning as a recording condition changing unit sets a recording condition for forming an evaluation image. If a recording condition has already been set, the recording condition changing portion 43 changes the recording condition. The changing of the recording condition is carried out so that micro-beading is less likely to occur. Examples of the direction of the change of the recording condition in order to suppress the occurrence of micro-beading include "to reduce the driving frequency of the recording head", "to increase the temperature of the recording medium", "to increase the temperature of the ink", "to increase the application amount of the reaction liquid", and the like. Step S1 is referred to as a recording condition changing step.

For example, by reducing the driving frequency of the recording head, the time interval between recording dots is lengthened, thereby allowing enough time for the ink in a previously ejected recording dot to aggregate to suppress the occurrence of micro-beading. Further, increasing the temperature of the recording medium and the temperature of the ink, and increasing the application amount of the reaction liquid promote shortening of the aggregation time of the ink in the recording dots, and thus are effective measures for suppressing micro-beading. The thus set or changed recording condition is set in the recording unit 10 by the apparatus controlling unit 15, and is used during formation of the evaluation image.

Next, in Step S2, the evaluation image input portion 44 functioning as an evaluation image input unit outputs, to the apparatus controlling unit 15, evaluation image data 41 for forming an evaluation image for determining whether or not micro-beading has occurred. Consequently, in Step S3, ink is ejected from the ink jet recording head 11 in the recording unit 10 to form the evaluation image on the recording medium 31. Step S3 is referred to as an evaluation image forming step.

Figure 4:
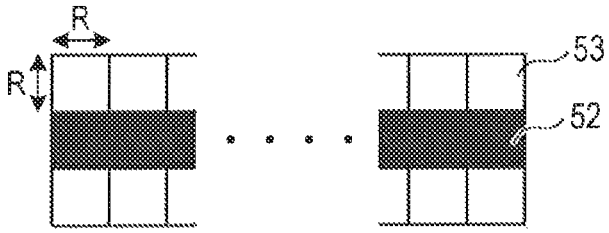
FIG. 4 is a schematic diagram illustrating an example of evaluation image data.

FIG. 4 schematically illustrates the evaluation image data 41. The evaluation image to be formed from the evaluation image data is illustrated in an enlarged manner in which the shape of the recording dot is ignored. In FIG. 4, the length R of each side of a unit box corresponds to the recording dot resolution. Further, each box demarcated by white and black indicates whether or not a recording dot is ejected by the ink jet recording head 11.

Figure 5:
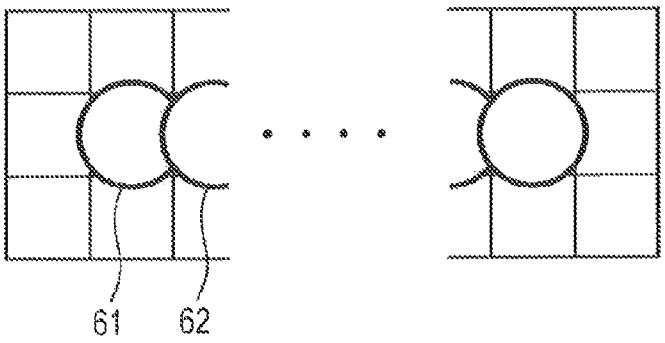
FIG. 5 schematically illustrates application of a recording dot on a recording medium.

For example, a recording dot is ejected on a location corresponding to a box 52 indicated by black, and a recording dot is not ejected on a location corresponding to a box 53 indicated by white. Therefore, when an image is formed on the recording medium 31 by outputting digital data such as that described with reference to FIG. 4 as the evaluation image data, an evaluation image like that illustrated in FIG. 5 is formed. FIG. 5 illustrates a recording dot 62 which is applied on the recording medium 31 so as to overlap a part of a previously applied recording dot 61.

The image to be used as the evaluation image is not particularly limited, as long as a correlation can be obtained between whether or not micro-beading has occurred and the evaluation value calculated from the evaluation image. However, as illustrated in FIG. 5, as the evaluation image, it is desired to use a fine line image in which adjacent recording dots 61 and 62 are successively arranged. In the examples described below, such a fine line image is used as the evaluation image.

In the recording unit 10, the recording medium 31 is continuously conveyed. The recording medium 31 on which the evaluation image has been formed by the ink jet recording head 11 is moved to the position of the imaging device 14. In Step S4, the imaging device 14, which is a reading unit, captures the evaluation image formed on the recording medium 31, and the imaging data is transmitted to the evaluation value calculating portion 45.

When the imaging data is received, next, in Step S5, the evaluation value calculating portion 45, which is an evaluation value calculating unit, calculates an evaluation value for determining whether or not micro-beading has occurred based on the imaging data, namely, based on the read image. For example, in the case illustrated in FIG. 5, the recording dot 61 is recorded before the recording dot 62 by a predetermined time interval. Consequently, the recording dots are successively arranged in a straight line. When the driving frequency of the recording head is low, a next recording dot is applied after completion of aggregation of the ink in the previous recording dot that has been applied on the recording medium 31. In this case, the coloring material in the ink is fixed, and hence there is no effect on dot formation of the subsequent recording dots. Consequently, an image is recorded having narrow portions, like those illustrated in FIG. 6A, between the recording dots. On the other hand, when the driving frequency is high, a next recording dot is applied before completion of aggregation of the ink in the previous recording dot that has been applied on the recording medium 31. In this case, as illustrated in FIG. 6B, a thick image without any narrow portions is recorded.

Thus, changes are produced in the evaluation image based on whether or not aggregation of the ink has been completed at the time of the application of a next recording dot after the application of the previous recording dot. Due to such a difference in the evaluation image, as is also clear from the following examples, the average value of the lightness value calculated based on the imaging data and the level of periodicity of the lightness value change. Accordingly, in this embodiment, the lightness value is extracted from the imaging data as color information, and the evaluation value is calculated based on the extracted lightness value.

The evaluation value may be an average value of the lightness value for a predetermined fixed range of the evaluation image (this is referred to as the average value of lightness), or may be a value that is based on how much the lightness value changes in a period corresponding to the recording dot resolution. Alternatively, using a color difference or a spectroscopic profile as the color information, the evaluation value may be calculated based on the color difference or the spectroscopic profile.

When the evaluation value has been calculated, next, in Step S6, the acceptance/rejection determining portion 46, which is an acceptance/rejection determining unit, compares the evaluation value with the acceptance/rejection determining threshold value 42 to determine whether or not micro-beading has occurred, namely, whether or not the recording quality is to be accepted or rejected. The acceptance/rejection determining threshold value is determined in advance based on an evaluation value calculated by the same evaluation method as the evaluation method that is subsequently used, by taking under the same imaging condition an image for which it has already been determined that micro-beading has not occurred. The acceptance/rejection determining threshold value may change based on the type of recording medium, the recording dot diameter, and the like. Therefore, an acceptance/rejection determining threshold value for each type of recording medium and each recording dot diameter may be stored in advance in the image processing/operation unit 16, and the appropriate acceptance/rejection determining threshold value may be selected when the acceptance or rejection is determined.

When determined to be acceptable due to no occurrence of micro-beading, the acceptance/rejection determining portion 46 outputs a signal indicating acceptance to proceed to Step S7. In Step S7, the recording condition deciding portion 47 functioning as a recording condition deciding unit sets the recording condition for which it has been determined that micro-beading does not occur in the recording unit 10 via the apparatus controlling unit 15 as a final recording condition for the recording medium 31.

When there are a plurality of recording conditions that do not cause micro-beading, it is preferred to decide the recording condition by arranging these recording conditions in order of priority. For example, when the productivity has the highest priority, it is desired to select the recording condition having the highest driving frequency of the recording head among the recording conditions determined not to cause micro-beading to decide the recording condition. When the recording condition is decided in Step S7, the processing for setting the optimal recording condition is finished. Then, a normal recording step is carried out to form a desired image on the recording medium 31.

On the other hand, in Step S6, when determined to be not acceptable due to occurrence of micro-beading, the proces returns to Step S1 to again change the recording condition toward suppression of micro-beading. In order to suppress the occurrence of micro-beading, for example, the recording condition is changed so as to, for example "reduce the driving frequency of the recording head", "increase the temperature of the recording medium", "increase the temperature of the ink", or "increase the application amount of the reaction liquid". Then, the processing of Steps S1 to S6 is repeated until the acceptance/rejection determining portion 46 determines that the recording condition is accepted.

Reaction Liquid

Now, the reaction liquid that can be used in the ink jet recording apparatus according to the present invention is described.

The reaction liquid contains an ink viscosity increasing component for increasing the viscosity of ink that has flown from the ink jet recording head and has been applied on the recording medium. Herein, the increase of the viscosity of the ink encompasses the case where a coloring material, a polymer, or the like, which is part of the composition of the ink, is brought into contact with the ink viscosity increasing component in the reaction liquid to cause a chemical reaction or physical adsorption, and as a result, a viscosity increase of the ink as a whole is observed. Further, the viscosity increase of the ink also encompasses the case where part of the ink composition, such as the coloring material, is aggregated to cause a local viscosity increase. The ink viscosity increasing component has the following effect: the ink viscosity increasing component lowers the fluidity of the ink and/or part of the ink composition on the recording medium to suppress bleeding or beading at the time of image formation.

In an exemplary embodiment of the present invention, as the ink viscosity increasing component, a hitherto known one such as a polyvalent metal ion, an organic acid, a cationic polymer, or porous fine particles may be used without any particular limitation. Of those, a polyvalent metal ion and an organic acid are suitable as the ink viscosity increasing component. In addition, it is also suitable to incorporate a plurality of kinds of the ink viscosity increasing components into the reaction liquid.

The content of the ink viscosity increasing component in the reaction liquid is preferably 5 mass % or more with respect to the total mass of the reaction liquid.

Specific examples of the metal ion that may be used as the ink viscosity increasing component include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$.

In addition, specific examples of the organic acid that may be used as the ink viscosity increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumaric acid, thiophenecarboxylic acid, nicotinic acid, oxysuccinic acid, and dioxysuccinic acid.

The reaction liquid that may be used in the present invention may contain an appropriate amount of water or an organic solvent. It is preferred that the water to be used in this case be water deionized by ion exchange treatment or the like. The organic solvent that may be used for the reaction liquid is not particularly limited, and any known organic solvent may be used.

In addition, various polymers may be added to the reaction liquid that may be used in the present invention. The addition of an appropriate polymer to the reaction liquid is suitable because the addition can, for example, enhance the mechanical strength of a final image. The polymer material to be used is not particularly limited as long as the polymer material can coexist with the ink viscosity increasing component.

In addition, a surfactant or a viscosity modifier may be added to the reaction liquid to adjust its surface tension or viscosity as appropriate before its use. The surfactant or viscosity modifier to be used is not particularly limited as long as the surfactant or the viscosity modifier can coexist with the ink viscosity increasing component. A specific example of the surfactant to be used is Acetylenol E100 (manufactured by Kawaken Fine Chemicals Co., Ltd.).

Application of Reaction Liquid

As for a method of applying the reaction liquid onto the surface of the recording medium, hitherto known various techniques may be used as appropriate. Examples of the technique for applying the reaction liquid include die coating; blade coating; a technique involving using a gravure roller; a technique involving using an offset roller; and spray coating. In addition, an application method involving using an ink jet recording head is also suitable. Further, it is also extremely suitable to use a plurality of methods in combination.

Drawing

Next, ink is applied in the form of an image onto the surface of the recording medium on which reaction liquid has thus been applied using the ink jet recording head.

Examples of the ink jet recording head to be used in the ink jet recording apparatus according to the present invention may include the following.

(a) An ink jet recording head configured to eject ink by forming air bubbles by causing film boiling in the ink with an electrothermal converter.

(b) An ink jet recording head configured to eject ink with an electromechanical converter.

(c) An ink jet recording head configured to eject ink utilizing static electricity.

In the present invention, any of the various types of ink jet recording head proposed in the ink jet liquid ejecting technology may be used. Among those proposed ink jet recording heads, from the perspective of enabling fast and high-density printing, it is preferred to use an ink jet recording head that utilizes an electrothermal converter.

Further, the mode of the overall ink jet recording head is not particularly limited. A so-called shuttle type ink jet recording head configured to perform recording while scanning the recording head in the direction perpendicular to the advancing direction of the recording medium may be used. Alternatively, a so-called line head type ink jet recording head in which the ink ejection orifices are arranged in a line in a direction roughly perpendicular to the advancing direction of the recording medium may also be used.

In addition, in the present invention, the recording system during ink jet recording is also not limited. For example, for a shuttle type ink jet recording head, a multi-pass recording system in which recording is performed by subjecting the same recording position to plural times of scanning may be used, or a one-pass recording system in which recording is performed by subjecting the same recording position to scanning only once may be used. Still further, a method can also be used in which recording is performed by dividing the image into a plurality of mask patterns.

Ink

Components that may be used for the ink to be used in the ink jet recording apparatus according to the present invention are described.

Coloring Material

The ink to be used in the present invention may use a coloring material having dissolved and/or dispersed therein, for example, a known dye, carbon black, or organic pigment. Of those, various pigments are suitable because their advantageous features include the durability and quality of printed products.

Pigment

The pigment that may be used in the present invention is not particularly limited, and a known inorganic pigment or organic pigment may be used. Specifically, a pigment indicated by a color index (C.I.) number may be used. In addition, it is also preferred to use carbon black as a black pigment. The content of the pigment in the ink is preferably 0.5 mass % or more and 15.0 mass % or less, more preferably 1.0 mass % or more and 10.0 mass % or less with respect to the total mass of the ink.

Pigment Dispersant

As a dispersant for dispersing the pigment in the ink, any known dispersant that has hitherto been used in an ink jet recording system may be used. In particular, in the present invention, it is preferred to use a water-soluble pigment dispersant having both a hydrophilic moiety and a hydrophobic moiety in its structure. It is particularly preferred to use a pigment dispersant containing a polymer having copolymerized therein at least a hydrophilic monomer and a hydrophobic monomer.

Each of the monomers to be used in this case is not particularly limited, and it is suitable to use hitherto known monomers. Specifically, examples of the hydrophobic monomer include styrene, a styrene derivative, an alkyl (meth) acrylate, and benzyl (meth)acrylate, and examples of the hydrophilic monomer include acrylic acid, methacrylic acid, and maleic acid.

It is preferred that the pigment dispersant have an acid value of 50 mg KOH/g or more and 550 mg KOH/g or less. In addition, it is preferred that the pigment dispersant have a weight-average molecular weight of 1,000 or more and 50,000 or less.

Note that, it is preferred that the mixing ratio between the pigment and the pigment dispersant fall within the range of from 1:0.1 to 1:3 in terms of mass ratio.

In addition, it is also suitable in the present invention to use a so-called self-dispersible pigment, which can be dispersed by virtue of a modified surface of the pigment itself without the use of any pigment dispersant.

Polymer Fine Particles

The ink to be used in the present invention may contain various fine particles containing no coloring material. Of such various fine particles, polymer fine particles are suitable because the polymer fine particles may have improving effects on image quality and fixability.

The material for the polymer fine particles that may be used in the present invention is not particularly limited, and a known polymer may be used as appropriate. Specific examples thereof include homopolymerization products such as polyolefin, polystyrene, polyurethane, polyester, polyether, polyurea, polyamide, polyvinyl alcohol, poly(meth) acrylic acid and a salt thereof, a polyalkyl (meth)acrylate, and polydiene; and a copolymerization product as a combination of a plurality of the homopolymerization products. It is suitable that such polymer have a mass-average molecular weight within the range of from 1,000 or more to 2,000,000 or less. In addition, the amount of the polymer fine particles in the ink is preferably 1 mass % or more and 50 mass % or less, more preferably 2 mass % or more and 40 mass % or less with respect to the total mass of the ink.

In an embodiment of the present invention, it is preferred that the above-mentioned polymer fine particles be used as a polymer fine particle dispersion by being dispersed in a liquid. A technique for dispersing the polymer fine particles is not particularly limited, but it is suitable to use a so-called self-dispersion-type polymer fine particle dispersion, which is obtained by using and dispersing a polymer obtained through homopolymerization of a monomer having a dissociable group or copolymerization of a plurality of kinds of such monomers. In this case, examples of the dissociable group include a carboxyl group, a sulfonic acid group, and a phosphoric acid group, and examples of the monomer having the dissociable group include acrylic acid and methacrylic acid.

In addition, in the present invention, it may be also suitable to use a so-called emulsion-dispersion-type polymer fine particle dispersion, which is obtained by dispersing the polymer fine particles with an emulsifier. As the emulsifier as used in this case, a known surfactant is suitably used, irrespective of whether the surfactant has a low molecular weight or a high molecular weight. It is suitable that the surfactant be nonionic, or have the same charge as the polymer fine particles.

The polymer fine particle dispersion has a dispersion particle diameter of desirably 10 nm or more and 1,000 nm or less, more desirably 100 nm or more and 500 nm or less.

In addition, in the present invention, it is also preferred to add various additives for stabilization when the polymer fine particle dispersion described above is produced. Suitable examples of the additives include n-hexadecane, dodecyl methacrylate, stearyl methacrylate, chlorobenzene, dodecylmercaptan, an olive oil, a blue dye (Blue 70), and polymethyl methacrylate.

Surfactant

The ink to be used in the present invention may contain a surfactant. A specific example of the surfactant is Acetylenol EH (manufactured by Kawaken Fine Chemicals Co., Ltd.). The amount of the surfactant in the ink is preferably 0.01 mass % or more and 5.0 mass % or less with respect to the total mass of the ink.

Water and Water-Soluble Organic Solvent

The ink to be used in the present invention may contain water and/or a water-soluble organic solvent as a solvent. It is preferred that the water be deionized water subjected to deionization treatment by ion exchange or the like. In addition, it is preferred that the content of the water in the ink be 30 mass % or more and 97 mass % or less with respect to the total mass of the ink.

In addition, the kind of the water-soluble organic solvent to be used is not particularly limited, and any known organic solvent may be used. Specific examples of the water-soluble organic solvent include glycerin, diethylene glycol, polyethylene glycol, and 2-pyrrolidone. In addition, the content of the water-soluble organic solvent in the ink is preferably 3 mass % or more and 70 mass % or less with respect to the total mass of the ink.

Other Additives

In addition to the components, the ink to be used in the present invention may contain various additives such as a pH regulator, a rust preventive, an antiseptic, an anti-mold agent, an antioxidant, a reduction inhibitor, a water-soluble resin and a neutralizer therefor, and a viscosity modifier.

EXAMPLES

Now, the present invention is more specifically described by way of Examples in which recording was actually performed on a recording medium using the ink jet recording apparatus according to the present invention. Note that, the present invention is not limited to Examples below, and various modifications are possible without departing from the gist of the present invention. In addition, "part(s)" and "%" in the description are by mass unless otherwise specified. The ink jet recording apparatus used in Examples had the structure illustrated in FIG. 1. In Examples, AURORA COAT paper (basis weight: 127.9 g/m$^2$) was used as the recording medium 31. The recording medium 31 has a reaction liquid applied thereonto by the roller application device 21.

That used as the ink jet recording head 11 was an ink jet recording head being configured to eject ink by an on-demand system with an electrothermal conversion element and having a line head form in which ink ejection orifices were arrayed in a direction substantially perpendicular to the conveying direction of the recording medium. In Examples, ink jet recording heads for the respective colors of black (Bk), cyan (C), magenta (M), and yellow (Y) were provided, and the four ink jet recording heads were arranged parallel to the conveying direction of the recording medium 31 and used as a set. Those ink jet recording heads 11 were used to form an image on the recording medium 31 having the reaction liquid applied thereonto, at a recording dot resolution of 1,200 dpi (at a dot density of 1,200 dots per 25.4 mm). When the recording dot resolution is 1,200 dpi, the distance between the centers of the dots is 21 μm.

The recording conditions which may relate to micro-beading were set as follows: "an ink ejection amount of 3 pl," "an ink temperature of 60° C.," "a recording medium temperature of 50° C.," and "a reaction liquid application amount of 1 g/m$^2$." Then, under the set recording conditions, recording was performed with varying driving frequencies of the recording heads, and the recorded images were evaluated.

Preparation of Reaction Liquid

The reaction liquid was prepared by mixing components having the following composition, thoroughly stirring the mixture, and then filtering the mixture under pressure through a microfilter having a pore size of 3.0 μm (manufactured by FUJIFILM Co.).

| | |
|---|---|
| Glycerin | 20.0% |
| Calcium chloride tetrahydrate | 16.0% |
| Surfactant Acetylenol EH (manufactured by Kawaken Fine Chemicals Co., Ltd.) | 1.0% |
| Pure water | 63.0% |

Ink

Inks used in Examples were produced by the following procedures.

Preparation of Black Pigment Dispersion Liquid

The following components were mixed: 10% of carbon black (product name: Monarch 1100, manufactured by Cabot Corporation), 15% of an aqueous solution of a pigment dispersant (styrene-ethyl acrylate-acrylic acid copolymer (acid value: 150 mg KOH/g, weight-average molecular weight: 8,000); solid content: 20%; neutralized in advance with potassium hydroxide), and 75% of pure water. The mixture was put into a batch-type vertical sand mill (manufactured by AIMEX CO., LTD.), which was filled with 200% of zirconia beads having a diameter of 0.3 mm. Then, the mixture was subjected to dispersion treatment for 5 hours under cooling with water. The dispersion liquid was centrifuged to remove coarse particles. Thus, a black pigment dispersion liquid having a pigment concentration of about 10% was obtained.

Preparation of Cyan Pigment Dispersion Liquid

A cyan pigment dispersion liquid was prepared by the same method as in the case of the preparation of the black pigment dispersion liquid except that 10% of carbon black used in the preparation of the black pigment dispersion liquid was replaced with 10% of C.I. Pigment Blue 15:3.

Preparation of Magenta Pigment Dispersion Liquid

A magenta pigment dispersion liquid was prepared by the same method as in the case of the preparation of the black pigment dispersion liquid except that 10% of carbon black used in the preparation of the black pigment dispersion liquid was replaced with 10% of C.I. Pigment Red 122.

Preparation of Yellow Pigment Dispersion Liquid

A yellow pigment dispersion liquid was prepared by the same method as in the case of the preparation of the black pigment dispersion liquid except that 10% of carbon black used in the preparation of the black pigment dispersion liquid was replaced with 10% of C.I. Pigment Yellow 74.

Production of Polymer Fine Particle Dispersion

The following components were mixed and stirred for 0.5 hour: 18% of butyl methacrylate, 2% of 2,2'-azobis-(2-methylbutyronitrile), and 2% of n-hexadecane. The mixture was added dropwise to 78% of a 6% aqueous solution of NIKKOL BC15 (manufactured by Nikko Chemicals Co., Ltd.) as an emulsifier, and the whole was stirred for 0.5 hour. Next, the resultant was irradiated with an ultrasonic wave using an ultrasonic irradiator for 3 hours. Then, a polymerization reaction was performed under a nitrogen atmosphere at 80° C. for 4 hours, and the resultant was cooled to room temperature, followed by filtration to obtain a polymer fine particle dispersion having a concentration of about 20%. The polymer fine particles had a mass-average molecular weight of from about 1,000 to 2,000,000, and a dispersion particle diameter of from about 100 nm to 500 nm.

Preparation of Ink

An ink having the composition according to the following formulation was prepared for each of black, cyan, magenta, and yellow. Specifically, the reaction liquid was prepared by mixing components according to the following formulation, thoroughly stirring the mixture, and then filtering the mixture under pressure through a microfilter having a pore size of 3.0 μm (manufactured by FUJIFILM).

Formulation

| | |
|---|---|
| Pigment dispersion liquid of each color described above (concentration: about 10%) | 20% |
| Polymer fine particle dispersion described above (concentration: about 20%) | 50% |
| Glycerin | 5% |
| Diethylene glycol | 7% |
| Acetylenol EH (manufactured by Kawaken Fine Chemicals Co., Ltd.) | 0.5% |
| Pure water | 17.5% |

Example 1

In Example 1, evaluation images were formed on the recording medium and evaluated by changing the driving frequency of the recording head to 0.5 kHz, 1 kHz, 1.3 kHz, 1.7 kHz, 2.5 kHz, and 5 kHz. First, the method used in Example 1 of determining whether or not micro-beading has occurred is described.

Figure 6A:
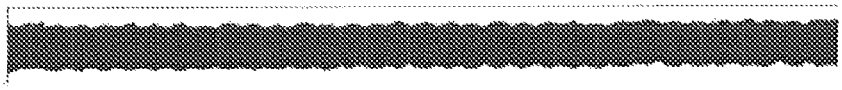
FIGS. 6A and 6B each illustrate an example of an evaluation image formed on the recording medium.
Figure 6B:
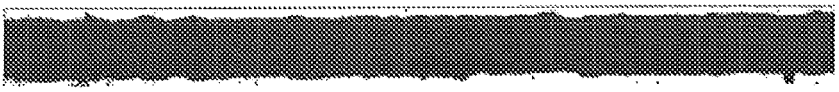
Figure 8:
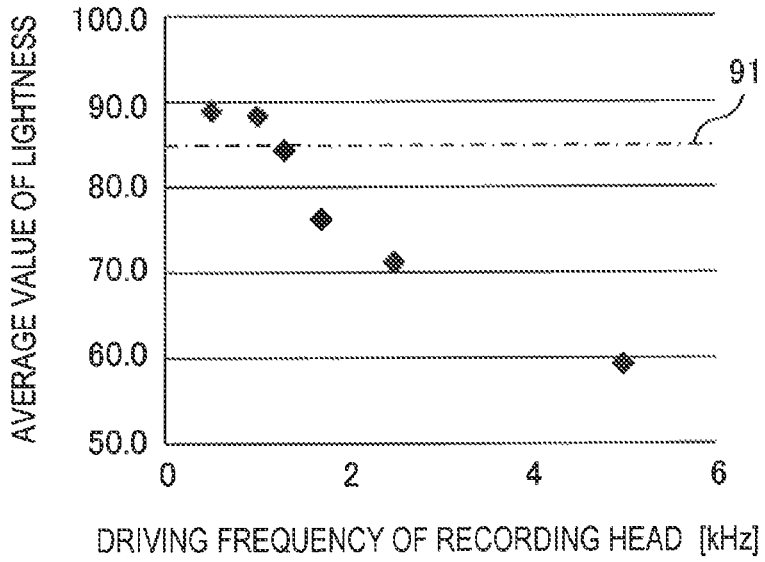
FIG. 8 is a graph showing a relationship in Example 1 between a driving frequency of a recording head and an average value of lightness for a taken image.

FIG. 7 illustrates in an enlarged manner a range including a plurality of fine line images like those illustrated in FIGS. 6A and 6B, in which a plurality of adjacent dots are successively arranged in a straight line. Here, in the evaluation image, an image of a 0.5 mm×0.5 mm imaging range 71 surrounded by the dashed line in FIG. 7 was taken by the imaging device 14. To calculate the evaluation value, the captured image was digitized, and the average value of lightness obtained by averaging the lightness value of each point in the imaging range 71 was taken as the evaluation value. FIG. 8 shows a relationship obtained in Example 1 between the driving frequency and the evaluation value. In FIG. 8, the horizontal axis represents the driving frequency of the recording head, and the vertical axis represents the calculated average value of lightness, namely, the evaluation value.

However, when the driving frequency of the recording head is high, a next recording dot may be applied on the recording medium before completion of aggregation of the previously applied recording dot. In such a case, the image may exhibit a low average value of lightness. Further, the time interval between recording dots tends to be longer when the driving frequency of the recording head is lower, and thus an image is formed so that a next recording dot is applied under the condition where aggregation has been completed. Consequently, such an image exhibits a high average value of lightness. In other words, with a condition that does not cause micro-beading, the average value of lightness increases. Therefore, in this example, an average lightness value of 85 of an evaluation image under a recording condition that does not cause micro-beading is used as the acceptance/rejection determining threshold value. In FIG. 8, the acceptance/rejection determining threshold value is indicated by a one-dot chain line 91.

In Example 1, when the driving frequency of the recording head was 1 kHz and 0.5 kHz, the average lightness value of the evaluation image in both cases was 90 or more. Therefore, it can be determined that setting the driving frequency of the recording head to 1 kHz and 0.5 kHz is a recording condition that does not cause micro-beading. In this example, it was supposed that image formation productivity had priority, and the recording condition deciding portion 47 decided that among the recording conditions determined to be acceptable, a high recording head driving frequency of 1 kHz was chosen as the recording condition.

When images formed on the recording medium 31 based on the decided recording condition were evaluated by observing whether or not micro-beading had occurred, micro-beading had not occurred with the recording condition determined as being acceptable. In other words, by using the ink jet recording method described in this example, a recording condition that does not cause micro-beading was able to be determined by numerically evaluating whether or not micro-beading occurred when the driving frequency of the recording head had been changed.

Example 2

In Example 2, evaluation images were formed on the recording medium and evaluated by changing the driving frequency of the recording head to 0.5 kHz and 5 kHz. FIG. 9A schematically illustrates an image in the case where the driving frequency of the recording head is set to 0.5 kHz, so that a next dot is applied after completion of ink aggregation of each dot. FIG. 9B schematically illustrates an image in the case where the driving frequency of the recording head is set to 5 kHz, so that a next dot is applied before completion of ink aggregation of each dot. In these images, whether or not micro-beading occurred was determined by measuring lightness along a solid line 81 passing through the center of the dots.

Figure 10A:
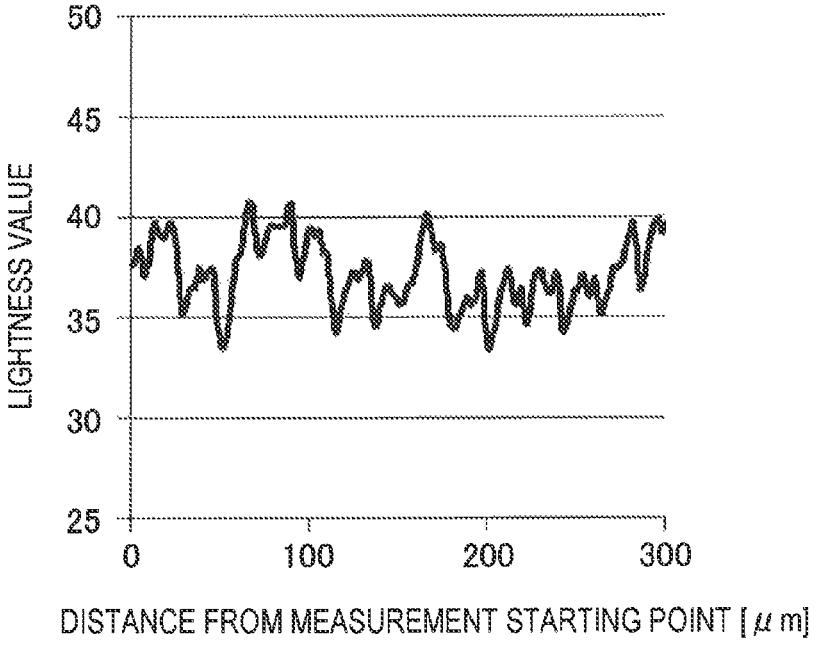
FIGS. 10A and 10B are each a graph showing changes in a measurement value of lightness according to Example 2.
Figure 10B:
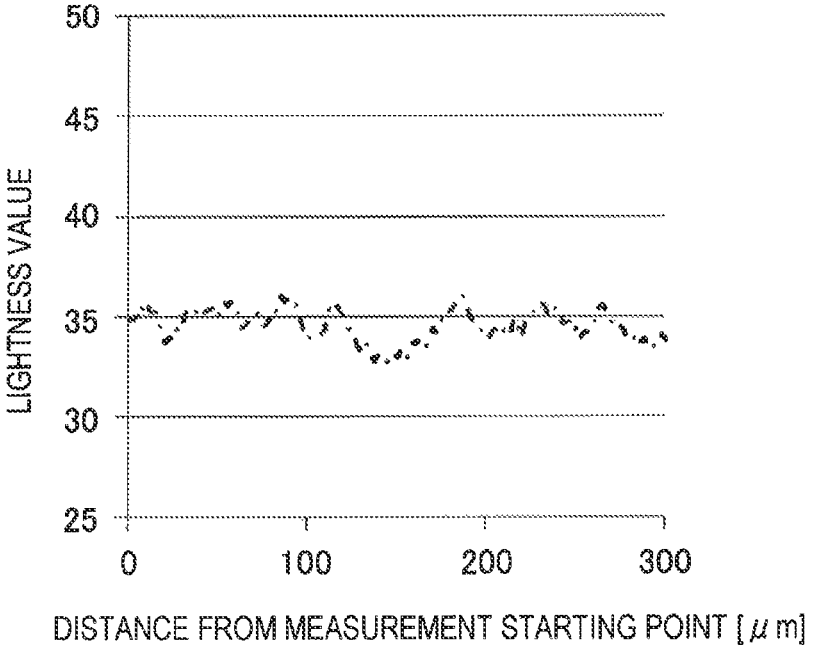

Using a microspectroscopy system as the imaging device 14 and the evaluation value calculating portion 45, the ranges illustrated in FIGS. 9A and 9B were taken as evaluation images at a resolution of about 42,000 dpi (42,000 pixels per 25.4 mm). Then, lightness was measured along the solid line 81 passing through the center of the recording dots in the imaging data. FIGS. 10A and 10B are graphs showing the measurement results of lightness in the images of FIGS. 9A and 9B, respectively. In both FIGS. 10A and 10B, the vertical axis represents the measured lightness, and the horizontal axis represents the distance from a measurement starting point 82.

When, as illustrated in FIG. 9A, a next dot was applied after completion of aggregation of the ink, a periodic change in lightness such as that shown in FIG. 10A was observed between a location 83 where dots overlapped and a location where the dots did not overlap. On the other hand, as illustrated in FIG. 9B, when a next dot was applied before completion of aggregation of the ink, as shown in FIG. 10B, a periodic change in lightness was not observed because adjacent dots were connected to each other.

Figure 11A:
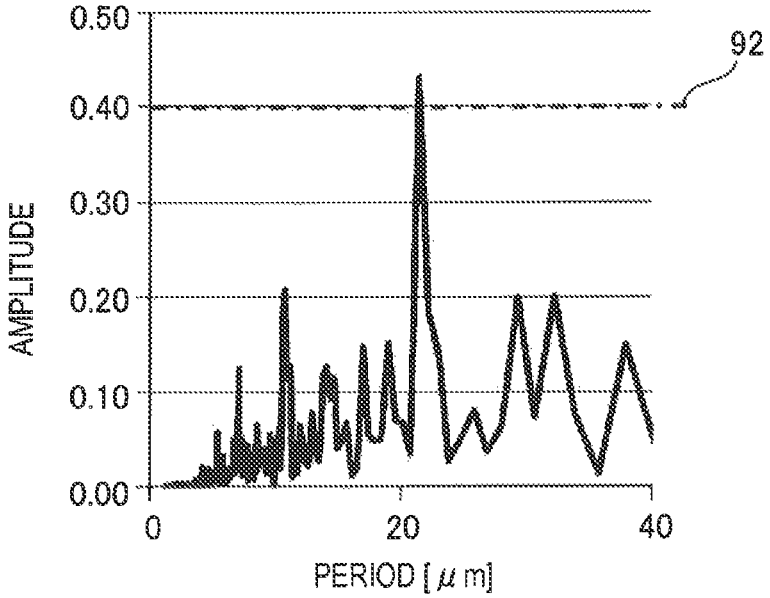
FIGS. 11A and 11B are each a graph showing a periodicity of the measurement value of lightness according to Example 2.
Figure 11B:
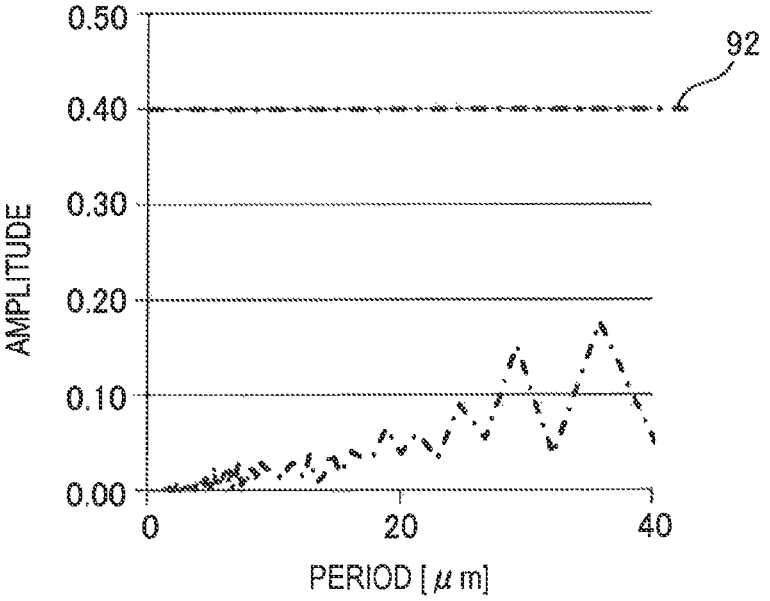

Next, the graphs showing change in lightness (FIGS. 10A and 10B) were subjected to a Fourier transform. The results of the Fourier transform carried out on the graphs of FIGS. 10A and 10B are shown in FIGS. 11A and 11B, respectively. Because a function of distance is subjected to a Fourier transform, the results obtained from the Fourier transform represent intensity at each spatial frequency. However, to facilitate the description, instead of spatial frequency, which is the inverse of distance, the horizontal axis represents a period having the dimension of distance.

When a next dot is applied after completion of aggregation of the ink, as shown in FIG. 11A, a high peak is produced near a period of 21 μm. As described above, 21 μm corresponds to the distance between the centers of the dots when recording is carried out at a recording dot resolution of 1,200 dpi. On the other hand, when a next dot is applied before completion of aggregation of the ink, as shown in FIG. 11B, a high peak is not observed at a period of 21 μm corresponding to the recording dot resolution. Thus, when micro-beading does not occur, a change in lightness for the period equivalent to the recording dot resolution can be confirmed in the evaluation image formed on the recording medium.

In this example, based on test values, the acceptance/rejection determining threshold value was set to a period intensity of 0.4. This threshold value is shown by a one-dot chain line 92 in FIGS. 11A and 11B. The case shown in FIG. 10A, in which a high periodicity intensity of 0.4 or more was shown at 21 μm, which was the period equivalent to the recording dot resolution, was accepted. Therefore, it was decided that a driving frequency of 0.5 kHz, which was the condition for the case shown in FIG. 11A, was selected by the recording condition deciding portion 47 as a recording condition that did not cause micro-beading.

When images formed on the recording medium 31 based on the decided recording condition were evaluated by observing whether or not micro-beading had occurred, micro-beading had not occurred with the recording condition determined as being acceptable.

It is known that the diameter of the recording dots on the recording medium changes when the temperature of the recording medium, the temperature of the ink, the application amount of the reaction liquid, and the like are changed. The method described in Example 2 determines whether or not micro-beading has occurred based on the intensity of a period component relating to the recording dot resolution, and hence the method described in Example 2 can also be applied when the recording dot diameter changes. If this method is used, a recording condition that does not cause micro-beading can be determined by numerically evaluating whether or not micro-beading occurs when various recording conditions, such as the driving frequency of the recording head, the temperature of the recording medium, the temperature of the ink, and the application amount of the reaction liquid, are changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-068273, filed Mar. 28, 2014, which is hereby incorporated by reference herein in its entirety.

What is claimed is:

1. An ink jet recording apparatus, which is configured to form an image corresponding to image data by applying ink droplets on a recording medium, the ink jet recording apparatus comprising:

a print head configured to apply ink droplets on the recording medium;

a recording condition changing unit configured to change a recording condition to be used upon formation of the image using the ink jet recording apparatus;

an evaluation image input unit configured to input evaluation image data representing an evaluation image as the image data in order to form the evaluation image on the recording medium, the evaluation image being an image comprising at least two successive adjacent dots;

an evaluation image forming control unit configured to cause the print head to form the evaluation image on the print medium based on the evaluation image data input by the evaluation image input unit and according to the recording condition changed by the recording condition changing unit;

a reading unit configured to read the evaluation image formed on the recording medium; and a recording condition determining unit configured to determine a recording condition upon formation of the image on the recording medium according to a degree of a change in lightness with a period equivalent to a recording dot resolution of the adjacent dots in the read image of the successive adjacent dots based on a reading result by the reading unit.

2. An ink jet recording apparatus according to claim 1, further comprising:

an evaluation value calculating unit configured to calculate an evaluation value based on color information on the evaluation image read by the reading unit; and an acceptance/rejection determining unit configured to determine acceptance/rejection of the evaluation image formed on the recording medium by comparing the evaluation value calculated by the evaluation value calculating unit with an acceptance/rejection determining threshold value, wherein the recording condition determining unit determines the recording condition based on a result of the acceptance/rejection determining unit, and when the acceptance/rejection determining unit determines rejection, the recording condition changing unit again changes the recording condition, and reading of the evaluation image, calculation of the evaluation value, and determination of the acceptance/rejection are repeated based on the again changed recording condition.

3. An ink jet recording apparatus according to claim 1, wherein the at least two successive adjacent dots comprise four successive adjacent dots.

4. An ink jet recording apparatus according to claim 1, wherein the recording condition to be changed by the recording condition changing unit comprises at least one of a driving frequency of a recording head, a temperature of the recording medium, a temperature of ink, and an application amount of a reaction liquid.

5. An ink jet recording apparatus according to claim 4, wherein the recording condition comprises the driving frequency of the recording head.

6. An ink jet recording method of forming an image corresponding to image data by applying ink droplets on a recording medium, the ink jet recording method comprising:

a recording condition changing step of changing a recording condition to be used upon formation of the image;

an evaluation image forming step of forming an evaluation image on the recording medium under the recording condition set in the recording condition changing step, the evaluation image being an image comprising at least two adjacent dots;

a reading step of reading the evaluation image formed on the recording medium; and a recording condition determining step of determining a recording condition upon formation of the image on the recording medium according to a degree of a change in lightness with a period equivalent to a recording dot resolution of the adjacent dots in the read image of the successive adjacent dots based on a reading result in the reading step.

7. An ink jet recording method according to claim 6, further comprising:

an evaluation value calculating step of calculating an evaluation value based on color information on the evaluation image read in the reading step; and an acceptance/rejection determining step of determining acceptance/rejection of the evaluation image formed on the recording medium by comparing the evaluation value calculated in the evaluation value calculating step with an acceptance/rejection determining threshold value, wherein the recording condition determining step determines the recording condition based on a result of the acceptance/rejection determining step, and when rejection is determined in the acceptance/rejection determining step, the recording condition changing step, the evaluation image forming step, the reading step, the evaluation value calculating step, and the acceptance/rejection determining step are repeated until acceptance is determined.

8. An ink jet recording method according to claim 6, wherein the at least two successive adjacent dots comprise four successive adjacent dots.

9. An ink jet recording method according to claim 6, wherein the recording condition to be changed in the recording condition changing step comprises at least one of a driving frequency of a recording head, a temperature of the recording medium, a temperature of ink, and an application amount of a reaction liquid.

10. An ink jet recording method according to claim 9, wherein the recording condition comprises the driving frequency of the recording head.

* * * * *